United States Patent [19]

Kubasov et al.

[11] 4,256,563

[45] Mar. 17, 1981

[54] ELECTRODE FOR ELECTROCHEMICAL PROCESSES AND PRODUCTION METHOD THEREFOR

[76] Inventors: Vladimir L. Kubasov, ulitsa Kirovogradskaya, 4, korpus 2, kv. 135; Leonid I. Jurkov, ulitsa Tashkentskaya, 22, korpus 1, kv. 124; Vladimir B. Busse-Machukas, Izmailovsky bulvar, 37, kv. 27; Georgy N. Kokhanov, ulitsa Melnikova, 23, kv. 29; Florenty I. Lvovich, 1 Nizhne-Mikhailovsky proezd, 16, kv. 55, all of Moscow, U.S.S.R.

[21] Appl. No.: 109,299

[22] Filed: Jan. 3, 1980

[51] Int. Cl.[3] ..... C25B 11/06; C25B 11/10

[52] U.S. Cl. ..... 204/290 F; 204/290 R; 204/291

[58] Field of Search ..... 204/290 R, 290 F, 291

[56] References Cited

U.S. PATENT DOCUMENTS

| | | | |
|---|---|---|---|
| 3,632,498 | 1/1972 | Beer | 204/290 F |
| 3,711,382 | 1/1973 | Anthony | 204/1 R |
| 4,070,504 | 1/1978 | Bianchi et al. | 427/126 |
| 4,098,669 | 6/1978 | de Nora et al. | 204/252 |
| 4,140,813 | 2/1979 | Hund et al. | 427/34 |

FOREIGN PATENT DOCUMENTS

| | | | |
|---|---|---|---|
| 2750305 | 5/1979 | Fed. Rep. of Germany | 204/290 F |
| 23352 | of 1898 | United Kingdom | 204/290 R |
| 1168558 | 10/1969 | United Kingdom . | |

*Primary Examiner*—F. C. Edmundson

*Attorney, Agent, or Firm*—Steinberg & Raskin

[57] ABSTRACT

An electrode for electrochemical processes comprises an electrically conductive base topped with a layer of active compound composed of, wt %:

| | |
|---|---|
| metal oxide from the platium group | 5–45 |
| at least one metal oxide from the iron and manganese group | 19–94.9 |
| boron oxide | 0.1–50 |

A method of fabricating the electrode for electrochemical processes involves deposition of an active compound on an electrically conductive base, the steps comprised in the procedure being application thereto of a solution made up of a thermally decomposed boric compound, at least one thermally decomposed metal compound from the iron and manganese group, and at least one thermally decomposed metal compound from the platinum group, and thermal treatment of said base at a temperature of 360° to 500° C.

Another method of fabricating the electrode for electrochemical processes involves deposition of an active compound on an electrically conductive base, the steps comprised in the procedure being application thereto of a first solution of a thermally decomposed metal compound from the platinum group; thermal treatment of said base at a temperature of 360° to 500° C., application thereto of a second solution made up of a thermally decomposed boric compound and at least one thermally decomposed metal compound from the iron and manganese group, and thermal treatment of said base at a temperature of 360° to 500° C.

5 Claims, No Drawings

ELECTRODE FOR ELECTROCHEMICAL PROCESSES AND PRODUCTION METHOD THEREFOR

FIELD OF THE INVENTION

The present invention relates to electrodes for electrochemical processes, which comprise an electrically conductive substrate coated with an active compound containing metal and boron oxides. The invention may be used as an anode assembly in electrolyzing alkaline-metal chloride solutions for the production of chlorine and sodium hydroxide by the use of electrolyzers with a filtering diaphragm. It is also suitable for electrolytic chlorate production, electroorganic synthesis, electrochemical purification of sewage and like effluents, and regeneration of etching solutions.

PRIOR ART

Until recently, graphite anodes were widely used in various electrochemical processes. The apparent advantages of such anodes are the use of readily available electrode material and insensitivity to short-circuits. However, the graphite anodes have a high chlorine evolution potential and, in effect, a high electrolyzer voltage and are not durable, a limitation necessitating frequent dismantling of the electrolyzers to enable anode set replacements. Furthermore, the graphite anodes are large and heavy, a feature increasing the dimensions of the electrolyzers and the work areas of the electrolysis shops beyond reasonable limits.

Widely used at the present time are electrodes comprising an electrically conductive base coated with an active compound. The electrically conductive base is fabricated from a suitable metal such, for example, as titanium, tantalum, zirconium, nobium or an alloy of these metals passivated in anode polarization. It may appear essentially in any shape, say, as a perforated or solid plate, bar, grid, or a metal-ceramic body.

Known in the art is an electrode assembly wherein an active compound contains metal oxides or mixtures of metal oxides from the platinum group, say, ruthenium (cf. British Pat. No. 1,168,558). The active surface is as thin as 3 to 10$\mu$. The metal anodes feature improved electrochemical characteristics, constant size over a long service period, smaller dimensions and weight, high stability of the active compound, and long anode set replacement intervals, say, several years, which is generally an apparent advantage over the prior art graphite anodes.

In the aforesaid electrode for electrochemical processes comprising an electrically conductive base fabricated from passivated material and topped with a layer of active compound containing metal oxide or a mixture of metal oxides from the platinum group (platinum, iridium, ruthenium, rhodium, palladium, osmium), the active compound may include manganese, lead, cobalt, titanium, tantalum and zirconium oxides or silica amounting to less than 50 wt % of the metal oxides or mixture of the metal oxides from the platinum group (cf. British Pat. No. 1,168,558). In such an electrode the expenditure of active compound containing, for example, ruthenium oxide is 7.5 mg/100° ampere-hours with a current density of 0.2 A/cm$^2$ for chlorine diaphragm electrolysis under stationary conditions, with the amount of lost active compound being determined gravimetrically.

Also known in the art is an electrode wherein an electrically conductive base of passivated metal is topped with a layer of active compound containing metal oxides from the platinum group and metal oxides from the iron and manganese group, which do not exhibit rectification properties. The active compound contains less than 50 wt % of the metal oxide from the platinum group, as referred to the weight of the metal oxide or mixture of the metal oxides, which do not exhibit rectification properties (cf. "Electrochemistry", Volume XII, No. 5, 1976, USSR Academy of Sciences, Moscow, pp. 787–789).

In such an electrode the expenditure of active compound is 4 to 5.7 mg/1000 ampere-hours with a current density of 0.2 A/cm$^2$ for chlorine diaphragm electrolysis under stationary conditions with the total number of ampere-hours during the experiment being 787–896 in the case of an active compound containing 31 wt % of ruthenium dioxide and 69 wt % of iron oxides.

A known electrode production method involves deposition of an active compound containing metal oxides from the platinum, iron and manganese groups on an electrically conductive base fabricated from a passivated material, the steps comprised in the procedure being application thereto of a solution of thermally decomposed compounds of said metals and thermal treatment of said base. The solution of thermally decomposed metal compounds may be applied repeatedly (cf. "Electrochemistry", Volume XII, No. 5, 1976, USSR Academy of Sciences, Moscow).

The active compound is applied to the electrically conductive base using a solution of thermally decomposed metal compounds from the platinum, iron and manganese groups whereupon said base is treated thermally.

With another known method a base is initially treated with a solution of thermally decomposed metal compound from the platinum group, the subsequent steps being thermal treatment of said base, application thereto of a solution of thermally decomposed compounds of other components, and repeated thermal treatment of said base (cf. FRG Applications Nos. 2,110,043 and 2,126,840 corresponds to U.S. Pat. No. 3,711,382).

OBJECT OF THE INVENTION

It is an object of the present invention to decrease expenditure of metals from the platinum group without degrading electrochemical characteristics of an electrode and to extend its service life.

BRIEF DESCRIPTION OF THE INVENTION

The electrode for electrochemical processes forming the subject of the present invention comprises an electrically conductive base topped with a layer of active compound composed of, wt %:

| | |
|---|---|
| metal oxide from the platinum group | 5–45 |
| at least one metal oxide from the iron and manganese group | 19–94.9 |
| boron oxide | 0.1–50 |

To enhance electrode stability, the active compound preferably contains ruthenium and iron oxides or cobalt oxide or a mixture of manganese and cobalt oxides.

The hereinproposed method of fabricating the electrode for electrochemical processes involves deposition of an active compound on an electrically conductive base, the steps comprised in the procedure being application thereto of a solution containing a thermally decomposed boric compound, at least one thermally decomposed metal compound from the iron and manganese group and at least one thermally decomposed metal compound from the platinum group, and thermal treatment of said base at a temperature of 360° to 500° C.

Desirably the solution is obtained by mixing the oxides in the following ratio, wt %:

| | |
|---|---|
| metal oxide from the platinum group | 5–45 |
| at least one metal oxide from the iron and manganese group | 19–94.9 |
| boron oxide | 0.1–50 |

It is of advantage that said solution contains thermally decomposed boric, iron and ruthenium or boric, cobalt and ruthenium or boric, cobalt, manganese and ruthenium compounds.

Another method of fabricating the electrode for electrochemical processes in compliance with the present invention involves deposition of an active compound on an electrically conductive base, the steps comprised in the procedure being application thereto of a first solution of a thermally decomposed metal compound from the platinum group, thermal treatment of said base at a temperature of 360° to 500° C., application thereto of a second solution containing a thermally decomposed boric compound and at least one thermally decomposed metal compound from the iron and manganese group, and thermal treatment of said base at a temperature of 360° to 500° C.

Desirably the solutions are obtained by mixing the oxides in the following ratio, wt %:

| | |
|---|---|
| metal oxide from the platinum group | 5–45 |
| at least one metal oxide from the iron and manganese group | 19–94.9 |
| boron oxide | 0.1–50 |

To enhance electrode stability it is advantageous that the first solution contains a thermally decomposed ruthenium compound and the second solution includes thermally decomposed boric and cobalt, or boric, cobalt and manganese or boric, cobalt and ruthenium compounds and at least one thermally decomposed metal compound from the platinum group.

The electrodes manufactured in compliance with the hereinproposed method possess an active surface whose stability is 1.2 to 2 times that of the prior art.

The electrocatalytic properties of the electrode forming the subject of the present invention are essentially similar to those of the known electrodes. The electrocatalytic activity has been estimated by comparing the anode potential with a standard hydrogen electrode under chlorine diaphragm electrolysis conditions. With a current density of 0.2 A/cm$^2$ in anode polarization the electrode potentials have been found to be within 1.34–1.37 V relative to a standard hydrogen electrode (s.h.e.) for a solution containing 300 g/l NaCl at 90° C., except for compositions containing manganese dioxide.

DETAILED DESCRIPTION OF THE INVENTION

The electrode forming the subject of the present invention may be fabricated as follows. A prepared base of a suitable electrically conductive material such, for example, as titanium is treated with a solution of metal compound from the platinum group mixed with metal compound from the iron and manganese group, which also includes boric acid. Thereafter said base is thermally treated at a temperature of 360° to 500° C.

In electrode production the electrically conductive base may be treated with a solution of thermally decomposed metal compounds from the platinum group, the subsequent steps being thermal treatment of said base at a temperature of 360° to 500° C., application of a solution of thermally decomposed compounds of boron and metals from the platinum, iron and manganese groups, and thermal treatment of said base.

In electrode production the electrically conductive base may also be treated with a solution containing thermally decomposed metal compounds from the platinum group, the subsequent steps being thermal treatment of said base at a temperature of 360° to 500° C., application of another solution of thermally decomposed compounds of boron and metals from the iron and manganese group, and thermal treatment of said base.

In electrode production in another embodiment of the invention the electrically conductive base may be treated with a solution containing thermally decomposed compounds of boron and metals from the platinum, iron and manganese groups, the subsequent steps being drying at a temperature of 20° to 150° C., and thermal treatment of said base at a temperature of 360° to 500° C.

The solution application and thermal treatment operations may be performed repeatedly.

Given herewith are typical examples of the practical realization of the invention.

EXAMPLE 1

Consider an electrode comprising an electrically conductive substrate representing a 30×40×2 titanium plate topped with a layer of active compound composed of, wt %: boron oxide—0.4; ruthenium dioxide—31; and iron oxides—68.6.

The production procedure is as follows. Degrease the titanium plate with 5% NaOH solution at 60° C. for 10 minutes and then etch it with 20% HCl solution at 100° C. To apply the active compound, prepare a solution containing 7.8 ml ferrous nitrate (1-mole solution), 1 g of ruthenium chloride solution with 19.2 wt % concentration and 0.2 ml of boric acid solution (0.5-mole solution). Apply the solution to the prepared titanium surface and allow it to dry for 40 minutes increasing the temperature gradually from 20° to 150° C. Next, allow a 20-minute waiting period at 150° and perform thermal treatment at 360° C. for 20 minutes. Repeat the operation six times. Having applied all the layers, heat the electrode at 470° for one hour. The total amount of active compound deposited on the electrode is 13.2 g per 1 m$^2$ of its surface.

The electrode has been tested under chlorine diaphragm electrolysis conditions at pH=3–5 with solution containing 300 g/l NaCl at 90° C. with an anode current density of 0.2 A/cm$^2$. The anode potential relative to a standard hydrogen electrode has been found to be 1.35 V (s.h.e.). The total number of ampere-hours during the test has been 2724.4. No active compound losses have been observed gravimetrically. The anode weight measuring accuracy has been ±0.05 mg.

EXAMPLE 2

Fabricate an electrode similar to that described in Example 1 using the above procedure. Apply the solution to the prepared titanium surface and allow it to dry at 120° C. for 15 minutes. Next, perform thermal treatment at 470° C. for 10 minutes. Repeat the operation eight times. The total amount of active compound deposited on the electrode is 17 g per 1 $m^2$ of its surface.

The electrode has been tested under chlorine diaphragm conditions at pH=4.5–5 with solution containing 300 g/l NaCl at 90° C. with an anode current density of 0.2 A/$cm^2$. The anode potential has been found to be 1.35 V (s.h.e.). The total number of ampere-hours during the test has been 2486. The active compound loss during the electrolyzing procedure has been 0.2 mg per 1000 ampere-hours.

EXAMPLE 3

Fabricate an electrode similar to that described in Example 1 using the above procedure but omitting the preliminary drying step. The total amount of active compound deposited on the electrode is 11 g per 1 $m^2$ of its surface.

The electrode has been tested under chlorine diaphragm electrolysis conditions at pH=3–4 with solution containing 280 g/l NaCl at 90° C. with an anode current density of 0.2 A/$cm^2$. The anode potential has been found to be 1.36 V (s.h.e.). The total number of ampere-hours during the test has been 1346.2. The active compound loss during the electrolyzing procedure has been 0.9 mg/1000 ampere-hours.

EXAMPLE 4

Fabricate an electrode similar to that described in Example 1 using the above procedure but omitting the preliminary drying step. The active compound should be composed of, wt %: ruthenium dioxide 31; iron oxides 67; and boron oxide 2. The total amount of active compound deposited on the electrode is 15.3 g per 1 $m^2$ of its surface.

The electrode has been tested under chlorine diaphragm electrolysis conditions at pH=3–4 with solution containing 280 g/l NaCl at 90° C. with an anode current density of 0.2 A/$cm^2$. The anode potential has been found to be 1.35 V (s.h.e.). The total number of ampere-hours during the test has been 1605.6. The active compound losses throughout the operating procedure have been 0.56 mg/1000 ampere-hours.

EXAMPLE 5

Fabricate an electrode similar to that described in Example 1 but having an active surface composed of, wt %: ruthenium dioxide—31; iron oxide—59; and boron oxide—10. The total amount of active compound deposited on the electrode is 10.5 g per 1 $m^2$ of its surface.

The electrode has been tested under chlorine diaphragm electrolysis conditions at pH=3–5 with solution containing 280 g/l NaCl at 90° C. with an anode current density of 0.2 A/$cm^2$. The anode potential has been found to be 1.37 V (s.h.e.). The total number of ampere-hours during the test has been 1751. No active compound losses have been observed.

EXAMPLE 6

Fabricate an electrode similar to that described in Example 1 using the above procedure but omitting the preliminary drying step with the active compound composed of, wt %: ruthenium dioxide—31; iron oxides—19; and boron oxide—50. The total amount of active compound deposited on the electrode is 13 g per 1 $m^2$ of its surface. In electrode production perform thermal treatment at a temperature of 500° C.

The electrode has been tested under chlorine diaphragm electrolysis conditions at pH=3–5 with solution containing 300 g/l NaCl at 90° C. with an anode current density of 0.2 A/$cm^2$. The electrode potential has been found to be 1.37 V (s.h.e.). The total number of ampere-hours during the test has been 900. The active compound expenditure during the electrolyzing procedure has been 1.2 mg/1000 ampere-hours.

EXAMPLE 7

Consider an electrode comprising an electrically conductive substrate representing a 30×40×2 titanium plate topped with a layer of active compound composed of, wt %: ruthenium dioxide—5; manganese oxide—84.3; cobalt oxide—10.3; and boron oxide—0.4.

The production procedure is as follows. Prepare the titanium base using the procedure described in Example 1. To apply the active compound, make use of solutions containing magnesium nitrate (1-mole solution), cobalt nitrate (1-mole solution), boric acid solution (0.5-mole solution), and ruthenium chloride solution with 19.2 wt % ruthenium concentration. Apply a coat of ruthenium chloride solution to the prepared titanium substrate and perform thermal treatment at 370° C. for 10 minutes. The amount of deposited metallic ruthenium is 1.3 g per 1 $m^2$ of the surface being treated. Next, apply a mixed solution of cobalt nitrate, manganese nitrate and boric acid prepared from the above solutions and perform thermal treatment at 380° C. for 20 minutes. Repeat the operation ten times. The total number of active compound deposited on the electrode is 35 g per 1 $m^2$ of its surface.

The electrode has been tested under chlorine diaphragm electrolysis conditions at pH=3–5 with solution containing 280 g/l NaCl at 90° C. with an anode current density of 0.1 A/$cm^2$. The anode potential relative to a standard hydrogen electrode has been found to be 1.5 V (s.h.e.). The total number of ampere-hours during the test has been 1070. The active compound expenditure has been equal to 3 mg/1000 ampere-hours.

EXAMPLE 8

Consider an electrode comprising an electrically conductive substrate representing a 30×40×2 titanium plate topped with a layer of active compound composed of, wt %: ruthenium oxide—5; cobalt oxide—94.9; and boron oxide—0.1.

The production procedure is as follows. Prepare the titanium plate as described in Example 1. To apply the active compound, prepare a mixture of cobalt nitrate solutions (1-mole solution), boric acid solution (0.5-mole solution) and ruthenium chloride solution with 19.2 wt % ruthenium concentration. Apply a coat of the ruthenium chloride solution to the prepared titanium substrate and then perform thermal treatment at a temperature of 370° C. for 10 minutes. The amount of deposited metallic ruthenium is 1.3 g per 1 $m^2$ of the working area. Next, apply a mixed solution of cobalt nitrate and boric acid, prepared from the above solutions and perform thermal treatment at 450° C. for 20 minutes. Having applied all the layers, heat the electrode at 470°

C. for one hour. The total amount of active compound deposited on the electrode is 30 g per 1 $m^2$ of its surface.

The electrode has been tested under chlorine diaphragm electrolysis conditions at pH=4–6 with solution containing 280 g/l NaCl at 90° C. with an anode density of 0.2 A/$cm^2$. The anode potential has been found to be 1.36 V (s.h.e.). The total number of ampere-hours has been 2050. The active compound expenditure has been 3 mg/1000 ampere-hours.

EXAMPLE 9

Consider an electrode comprising a 30×40×2 titanium plate topped with a layer of active compound composed of, wt %: ruthenium oxide—45; iron oxide—53; and boron oxide—2. The electrode is fabricated using the procedure described in Example 1. Apply a coat of ruthenium chloride solution with 19.2 wt % ruthenium concentration to the prepared titanium substrate and then perform thermal treatment at 370° C. for 10 minutes. The number of deposited metallic ruthenium is 1.3 g/$m^2$ of the working surface. The total amount of active compound deposited on the titanium plate is 12.5 g per 1 $m^2$ of the anode surface.

The electrode has been tested under diaphragm electrolysis conditions at pH=3–4 with solution containing 300 g/l NaCl at 90° C. with an anode current density of 0.2 A/$cm^2$. The anode potential has been found to be 1.35 V (s.h.e.). The total number of ampere-hours has been 1900. The active compound expenditure during the electrolyzing procedure has been 1 mg/1000 ampere-hours.

What is claimed is:

1. An electrode for electrochemical processes comprising an electrically conductive base topped with a layer of active compound composed of, wt %:

| | |
|---|---|
| metal oxide from the platium group | 5–45 |
| at least one metal oxide from the iron and manganese group | 19–94.9 |
| boron oxide | 0.1–50 |

2. An electrode as claimed in claim 1, wherein said active compound contains ruthenium oxide.

3. An electrode as claimed in claim 1, wherein said active compound contains iron oxide.

4. An electrode as claimed in claim 1, wherein said active compound contains cobalt oxide.

5. An electrode as claimed in claim 1, wherein said active compound contains a mixture of manganese and cobalt oxides.

* * * * *